US012650253B2

(12) United States Patent
Lee et al.

(10) Patent No.: US 12,650,253 B2
(45) Date of Patent: Jun. 9, 2026

(54) AIR CONDITIONER

(71) Applicant: KYUNGDONG NAVIEN CO., LTD., Pyeongtaek-si (KR)

(72) Inventors: Myoung Seop Lee, Seoul (KR); Wang Yun Kim, Seoul (KR); Moon Yong Park, Seoul (KR); Chul Ki Jeong, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 134 days.

(21) Appl. No.: 18/089,271

(22) Filed: Dec. 27, 2022

(65) Prior Publication Data

US 2023/0204265 A1 Jun. 29, 2023

(30) Foreign Application Priority Data

Dec. 27, 2021 (KR) ..... 10-2021-0188308
Dec. 22, 2022 (KR) ..... 10-2022-0181431

(51) Int. Cl.
*F25B 39/04* (2006.01)
*F25B 41/31* (2021.01)

(52) U.S. Cl.
CPC ..... *F25B 39/04* (2013.01); *F25B 41/31* (2021.01); *F25B 2339/041* (2013.01); *F25B 2600/2515* (2013.01); *F25B 2700/02* (2013.01)

(58) Field of Classification Search
CPC ..... F25B 39/04; F25B 2339/041; F25B 2600/2515; F25B 2700/02;
(Continued)

(56) References Cited

U.S. PATENT DOCUMENTS 6,715,312 B1 * 4/2004 Teakell ..... F28F 19/00 62/305
10,024,558 B2 * 7/2018 Vandermeulen ..... F25B 13/00
(Continued)

FOREIGN PATENT DOCUMENTS

KR 101794730 11/2017
KR 20190024394 A 3/2019
(Continued)

OTHER PUBLICATIONS

Korean Notice of Allowance (w/English translation) for corresponding Application No. 10-2022-0181431, mailed May 25, 2025, 5 pages.

*Primary Examiner* — Frantz F Jules
*Assistant Examiner* — Devon Moore
(74) *Attorney, Agent, or Firm* — Dority & Manning, P.A.

(57) ABSTRACT

An air conditioner is provided that includes an evaporator, an expansion valve, a compressor, and an evaporative condenser through which refrigerant circulates. The air conditioner further includes an outdoor unit in which the evaporative condenser is disposed; an indoor unit in which the evaporator is disposed; and a control unit connected to the indoor unit and the outdoor unit; wherein the evaporative condenser includes a cooling flow path through which a refrigerant passes and a condenser injection water module providing water to the cooling flow path, the outdoor unit includes a first control valve for controlling water supplied to the condenser injection water module, and the control unit is connected to the first control valve and the evaporative condenser, and changes the amount of water supplied through the first control valve according to operating conditions.

12 Claims, 7 Drawing Sheets

(58) Field of Classification Search
CPC ..... F25B 2700/2103; F25B 2700/2116; F25B 2700/2117; F24F 3/14; F24F 3/1423; F24F 3/147; F24F 2003/1464; F24F 1/0035; F24F 1/0038
See application file for complete search history.

(56) References Cited

U.S. PATENT DOCUMENTS

| | | | | |
|---|---|---|---|---|
| 10,775,059 | B2 * | 9/2020 | Lee | F24F 11/0008 |
| 10,876,749 | B2 * | 12/2020 | Jin | F24F 13/10 |
| 11,287,166 | B2 * | 3/2022 | Mohammad | F28C 1/14 |
| 2015/0354839 | A1 | 12/2015 | Lee | |
| 2022/0026095 | A1 * | 1/2022 | Abdel-Salam | F24F 11/65 |

FOREIGN PATENT DOCUMENTS

| | | | | |
|---|---|---|---|---|
| KR | 20190143734 | A | 12/2019 | |
| KR | 20200075244 | | 6/2020 | |
| WO | WO-2021232136 | A1 * | 11/2021 | F25B 41/00 |

* cited by examiner (a)

(b)

AIR CONDITIONER

CROSS-REFERENCE TO RELATED APPLICATION(S)

This application claims benefit of priorities to Korean Patent Application No. 10-2021-0188308 filed on Dec. 27, 2021 and 10-2022-0181431 filed on Dec. 22, 2022 in the Korean Intellectual Property Office, the disclosure of which is incorporated herein by reference in its entirety.

TECHNICAL FIELD

The present disclosure relates to an air conditioner, and more specifically, to an air conditioner including an evaporative heat exchanger an evaporative cooler, an evaporative condenser.

An air conditioner is a device that adjusts indoor temperature and humidity according to a user's request, or ventilating or purifying indoor air to maintain a comfortable indoor environment.

However, there is no device capable of controlling indoor temperature and humidity, ventilating indoor air, and even purifying indoor air, and if a plurality of devices capable of performing the functions are configured, a huge machine room to accommodate all of the devices is required, and high power is consumed to perform all of the functions, thereby reducing space efficiency and energy efficiency.

Patent document 1 discloses a system that uses the cooling output of a dehumidified cooling device to cool the condenser of a vapor compression type cooler.

However, in the case of patent document 1, water is sprayed through the evaporator injector along with the cooling output of the dehumidified cooling device in the cooling of the condenser, and the amount of water used to take sufficient heat from the refrigerant pipe of the condenser increases, which is undesirable because it eventually burdens the user with water costs.

The energy consumed by the air conditioner includes not only electrical energy but also water energy, but increasing the amount of water is not desirable because it not only increases the burden on consumers but also adversely affects the environment.

Meanwhile, patent document 2 illustrates an evaporative cooler. In the case of an evaporative heat exchanger including the evaporative cooler, water is atomized or sprayed into small particles to utilize evaporation heat that water evaporates and absorbs as it meets air, and in the case of such a spray nozzle, if the flow rate decreases, there is a limitation that it is neither atomized properly nor sprayed evenly.

PRIOR ART DOCUMENT (Patent document 1) KR 10-1794730 B
(Patent document 2) KR 10-20200075244 A

SUMMARY

An aspect of the present disclosure is to solve the problems of conventional technology as described above, and to provide an air conditioner that can reduce water consumption using an evaporative heat exchanger using water.

In order to achieve the object of the present disclosure, the preset invention provides an air conditioner as follow.

In one embodiment, the present disclosure describes an air conditioner including an evaporator in which refrigerant circulates, an expansion valve, a compressor, and an evaporative condenser, the air conditioner comprises an outdoor unit in which the evaporative condenser is disposed; an indoor unit in which the evaporator is disposed; and a control unit connected to the indoor unit and outdoor unit; and the evaporative condenser includes a cooling flow path through which a refrigerant passes and a condenser water injection module providing water to the cooling flow path, and a first control valve for controlling water supplied to the condenser water injection module, wherein the control unit is connected to the first control valve and the evaporative condenser, and according to operating conditions, the amount of water supplied through the first control valve is changed.

In one embodiment of the present disclosure, the outdoor unit comprises a dry channel, a wet channel arranged to exchange heat with the dry channel, and a cooler water in module providing water to the wet channel, and it further comprises an evaporative cooler connected to an inlet flow path through which outside air flows into the dry channel and a second control valve that controls the water supplied to the cooler water injection module, wherein the control unit is connected to the first and second control valves, the evaporative condenser, and the evaporative cooler, and according to operating conditions, the amount of water supplied through the first or second control valve is changed.

In one embodiment, the control unit can adjust a change in the amount of water supplied through the first and second control valves to an opening and closing pattern in which the first and second control valves are opened for a predetermined time and then closed for a predetermined time.

In one embodiment, the outdoor unit is disposed before the evaporative cooler on the inlet flowpath, and a dehumidification rotor for dehumidifying the incoming air; and a heating unit disposed before the dehumidification rotor on a regeneration flow passage through which air to regenerate the dehumidification rotor passes to heat the air, wherein the dehumidification rotor is disposed over the regeneration flow path and the inlet flow path, and the inlet flow path can pass through the evaporative cooler and branch into an indoor supply flow connected to the indoor and a condenser supply path connected to the evaporative condenser.

In the above configuration, the present disclosure may provide an air conditioner that provides an amount of water required for a situation while having a small amount of water consumption.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereafter, a preferred embodiment is described in detail so that a person skilled in the art can easily derive the present disclosure by referring to the attached drawing. However, in explaining a desirable embodiment of the present disclosure in detail, if it is determined that a detailed description of a related known function or configuration may unnecessarily obscure the point of the present disclosure, the detailed explanation thereof will be omitted. Also, for parts with similar functions and actions, the same signs are used throughout the figures. Also, in this specification, the terms such as "top," "upper part," "upper surface," "lower," "lower part," "lower surface," etc., are based on figures, and may actually vary depending on the direction in which the element or component is disposed.

Additionally, when one part is "connected" to the other part throughout the specification, this includes not only the case where it is "directly connected", but also the case where it is "indirectly connected" with another element in between. Also, 'including' any component means that other components can be further included rather than excluding other components unless otherwise stated.

Figure 1:
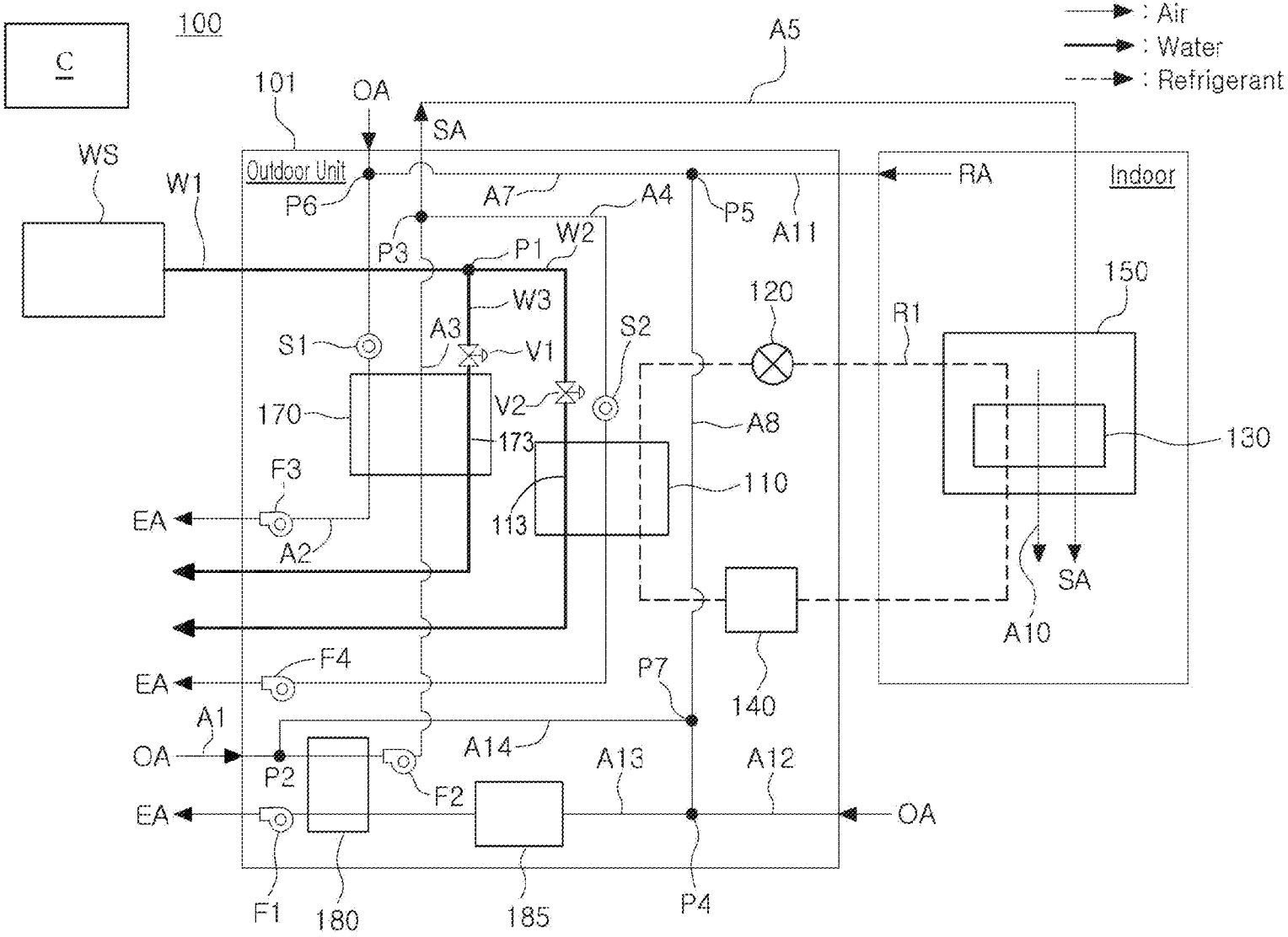
FIG. 1 is a schematic diagram of an air conditioner according to one embodiment of the present disclosure.

FIG. 1 illustrates a schematic diagram of an air conditioner according to one embodiment of the present disclosure, including a dehumidification rotor 180, an evaporative cooler 170, and an evaporative condenser 110.

In the schematic diagram in FIG. 1, fans and dampers for selective blocking/opening of air, water movement, and flow paths may be omitted or only partially displayed. The formation of a flow of air or water includes a means of forming a flow, and its position is not limited to a specific position if the flow can be formed.

The air conditioner 100 includes a refrigerant cycle R1 in which refrigerant circulates, and the refrigerant cycle R1 includes the evaporative condenser 110 that condenses the refrigerant into the condenser, and an expansion valve 120, an evaporator 130 that cools the air as the refrigerant evaporates, and a compressor 140. Since the expansion valve 120, evaporator 130, and compressor 140 of this refrigerant cycle R1 may be the same as a normal air conditioner, the detailed explanation is omitted.

The evaporative condenser 110 is a structure in which water is sprayed on the surface of the condenser to help cool the refrigerant as the water evaporates, and the evaporative condenser 110 comprises a cooling flow path which the refrigerant passes; a condenser water injection module that provides water with the cooling flow path and a blower module that forms an air flow passing through the cooling flow path. Here, the blower module may not be included in the evaporative condenser 110 but may be replaced with another fan, for example, a fan F4 disposed on the flow path passing through the evaporative condenser 110. The evaporative condenser 110 is disclosed in Patent Document 1 described above or Korea Public Patent Gazette 10-2019-0006781, and even if it is not this structure, other evaporative condensers can be applied as long as it is a condenser structure that utilizes evaporation of water. The condenser water injection module 113 of the evaporative condenser 110 is connected to a water supply source WS and a flow path W2, and a second control valve V2 is disposed in the flow path W2 to control the amount of water supplied from the water supply source WS to the condenser water injection module 113.

In one embodiment of the present disclosure, the second control valve V2 may be an electronic valve, such as a solenoid valve that may be turned on/off without controlling the flow rate and may be connected to the control unit to be opened or closed according to a signal of the control unit.

In the refrigerant cycle R1, the compressor 140, the evaporative condenser 110, and the expansion valve 120 can be disposed in the outdoor unit 101, and the evaporator 130 can be disposed in the indoor unit 150, except for the evaporative condenser 110, or disposed in a different air conditioning space. In the embodiment, the expansion valve 120 may be disposed directly before the evaporator 130 of the indoor unit.

In one embodiment, the air conditioner 100 includes the indoor unit 150 and the outdoor unit 101 disposed indoors, and the indoor unit 150 and the outdoor unit 101 can be connected to a refrigerant channel, an air channel, and an electric wire for transmitting the control signal and the power. However, in the case of the control signal, it may be transmitted wirelessly rather than wired.

The outdoor unit 101 comprises the evaporative cooler 170 disposed on the inlet flow A1, A3 through which outside air flows in, comprising a dry channel, a wet channel, and a cooler water injection module 173 for spraying water onto the dry channel, and cooling air passing through the dry channel; a dehumidification rotor 180 disposed before the evaporative cooler 170 on the inlet channel A1 and dehumidifies the incoming air; and a heating unit 185 disposed before the dehumidification rotor 180 on regeneration flow paths A12, A13 through which air passes to regenerate the dehumidification rotor 180 and heats the air.

The evaporative cooler 170 includes the dry channel through which the air that needs to be cooled passes, and the wet channel adjacent to the dry channel and heat-exchanging with the dry channel due to evaporation by supplying water from the coolant injection water module, and normally, the dry channel and the wet channel are arranged alternately, and the cooler water injection module is arranged on the top of the wet channel to provide water with the we channel, and a ventilation module is disposed on the upper or lower part, thereby generating a flow. Air from the inlet flow path A3 passes through the dry channel, and the outside air flow path A2 passes through the wet channel. The outside air flow path A2 is supplied to the outside air flow path A2, but indoor air can pass through the ventilation flow path A7 as needed.

Similar to the evaporative condenser 110, the ventilation module of the evaporative cooler 170 is not included in the evaporative cooler 170 and can be replaced with a dehumidification fan F2 disposed on the flow path A3 passing through the evaporative cooler 110.

The cooler water injection module 173 of the evaporative cooler 170 is connected to the water supply source WS and the flow path W3, and a first control valve V1 is disposed in the flow path W3, so that the amount of water supplied from the water supply source WS to the cooler injection water module 173 can be adjusted. In one embodiment of the present disclosure, the first control valve V1 may be sufficient to operate only on/off without controlling the flow rate, and may be the electronic valve such as a solenoid valve that is connected to the control unit and may be opened or closed according to a signal of the control unit.

It is natural that other structures can be applied to the evaporative cooler 170 if evaporation can be utilized, and even in this case, the water injection module is required for evaporation, and the first control valve is disposed in a flow path connected to the water injection module.

The dehumidification rotor 180 is disposed over the regeneration flow paths A12, A13 and the inlet flow path A1, and the dehumidification rotor 180 operates by absorbing moisture from the inlet flow path A1 through the rotating rotor and discharging the absorbed moisture from the regeneration flow paths A12, A13. A regeneration fan F1 is disposed in the regeneration flow paths A12, A13 to form an air flow in the regeneration flow paths A12, A13. The position of the regeneration fan F1 may be any position before and after the dehumidification rotor 130 as long as it may form an air flow passing through the dehumidification rotor 130.

The inlet flow path A1 may be connected to the ventilation flow path A14 connected to the indoor ventilation RA at the confluence point P2 before passing through the dehumidification rotor 180, and when indoor air is circulated, the indoor air may be introduced through the ventilation flow path A14 to supply the dehumidification rotor 180 again to the indoor air.

After passing through the evaporative cooler 170, the inlet flow paths A1, A3 are bifurcated from the channel outlet of the evaporative cooler 170 to the indoor supply channel A5 connected to the indoor at the branch point P3, and to the condenser supply channel A4 connected to the evaporative condenser 110.

The inlet flow paths A1, A3 pass through the evaporative cooler 170, and then branch from the dry channel outlet of the evaporative cooler 170 to the indoor supply flow path A5 connected to the indoor at the branch point P3, and the evaporative condenser 110 to the condenser supply flow path A4.

The indoor supply flow path A5 is connected to the indoor unit. 150, and can be supplied to the indoor in a cooled state after passing through the evaporator 130. However, the present disclosure is not limited thereto, and the evaporator 130 may pass through the indoor circulation flow path A10, and the indoor supply flow path A5 may be supplied from the ceiling to the indoor, or may be connected to the indoor unit 150 but may not pass through the evaporator 130.

A second temperature and humidity sensor S2 is disposed between the dry channel outlet side and the entrance side of the evaporative condenser 110 in the condenser supply flow path A4. The second temperature and humidity sensor 32 measures the temperature and humidity of the air supplied to the evaporative cooler 110.

Outside air is introduced into the outside air flow path A2 passing through the wet channel of the evaporative cooler 170, and some or all indoor air may be supplied through the confluence point P6, if necessary. On the outside air flow path A2 of the evaporative cooler 170, the first temperature and humidity sensor S1 is disposed in the inlet of the wet channel. The first temperature and humidity sensor S1 measures the temperature and humidity of the air supplied to the wet channel of the evaporative cooler 170 in the same way as the second temperature and humidity sensor S2.

Meanwhile, the air conditioner 100 can include a ventilation flow path A11 that discharges indoor air to the outside as much as corresponding to the amount of air supplied to the indoor, and this ventilation flow path A11 may be branched into the ventilation flow path A7 joining the outside air flow path A2 supplied to the wet channel of the evaporative cooler 170 at the branch point P5, and the ventilation flow path A8 that joins the regeneration flow path A13 of the dehumidifying rotor 180. The ventilation flow path A7 joins the outside air flow channel A2 passing through the wet channel of the evaporative cooler 170 at the confluence point P6, and the regeneration flow path A12 passing through the dehumidification rotor 180 joins at the confluence point P4. Meanwhile, in the case of the ventilation flow path A8 joining the regeneration flow path A13, the ventilation flow path A14 joining the inlet flow path A1 may be branched again at the branch point P7.

In this embodiment, it is explained that ventilation flow paths A11, A7, A8, A14 branch from the branch points P5, P7, but are not limited thereto, and if the ventilation flow path A11 can be connected to the outside air flow path A2 passing through the wet channel of the evaporative cooler 170, the inlet flow path A1 passing through the dehumidification rotor 180, or the regeneration flow path A13, it is also possible to branch in a different way, and the branch should not only be performed inside the outdoor unit 101, and it may also be branched from the flow path connected from the indoor unit 150 to the outdoor unit 101.

A water supply flow path W1 connected to the water supply source WS is branched into a water supply flow path W2 from the branch point P1 to the evaporative condenser 110 and a water supply flow path W3 to the evaporative cooler 170, and a water supply channels W2, W3 pass through the evaporative condenser 110, and the water supply channels W2, W3 supply the water that provides latent heat for condensing the refrigerant passing through the evaporative condenser 110 and the water that provides latent heat for cooling the air passing through the evaporative cooler 170. The water passing through the evaporative cooler 170 and the water passing through the evaporative condenser 110 are drained to the outside. If necessary, the water passing through the evaporative condenser 110 may be recovered without being drained and used again.

In one embodiment of the present disclosure, the air conditioner 100 includes a control unit C, and the control unit Cis connected to an input means (a control panel), an output means (a display), a movable means (a compressor and a fan), a control means (a flow path conversion valve, a damper), and a measuring means (a sensor), and can operate in a plurality of operating modes by receiving a user's instruction or determining itself.

Figure 2:
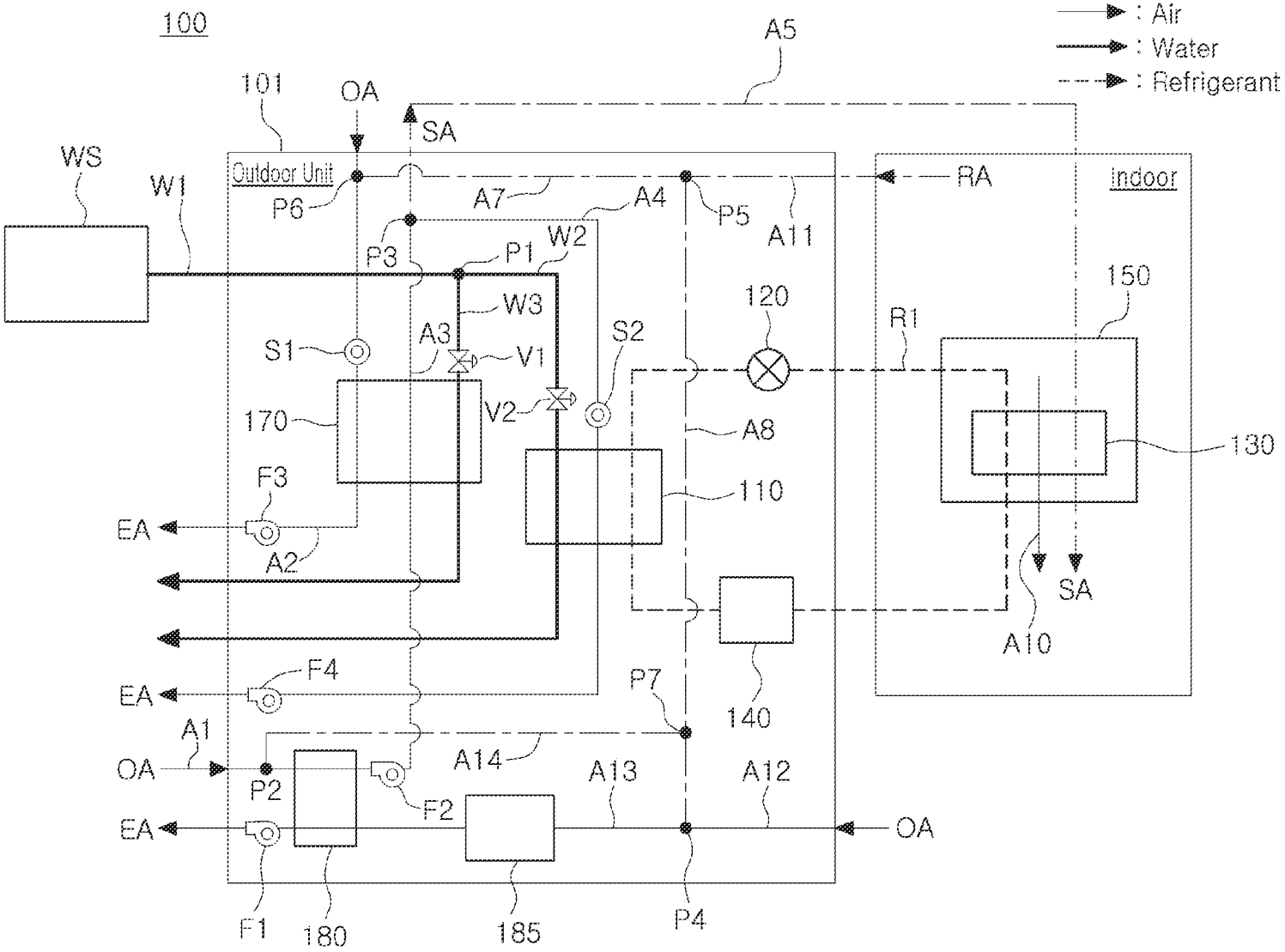
FIG. 2 is a schematic diagram of the air conditioner in FIG. 1 operating in cooling mode.
Figure 3:
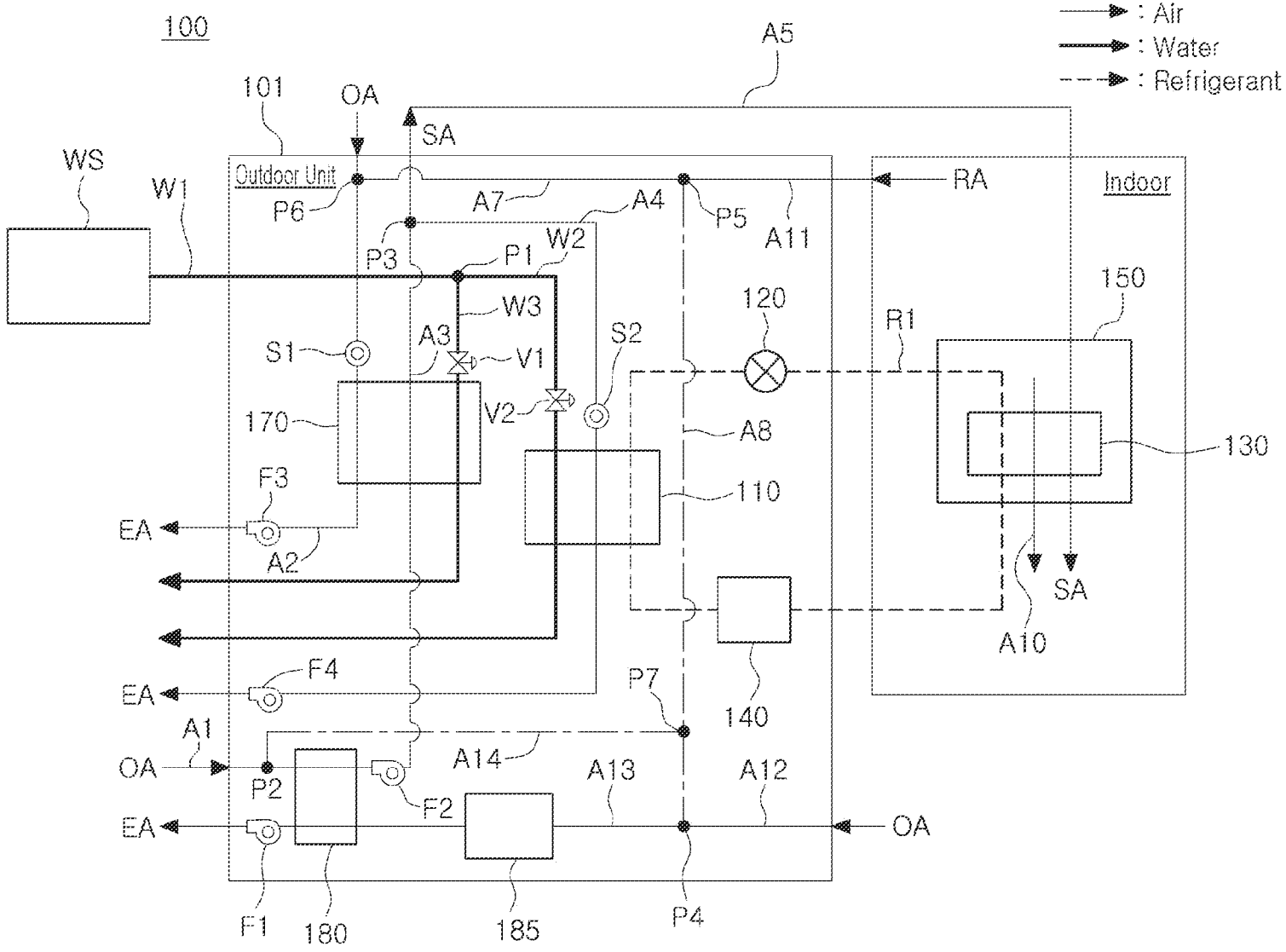
FIG. 3 is a schematic diagram of the air conditioner in FIG. 1 operating in air conditioning and ventilation mode.
Figure 4:
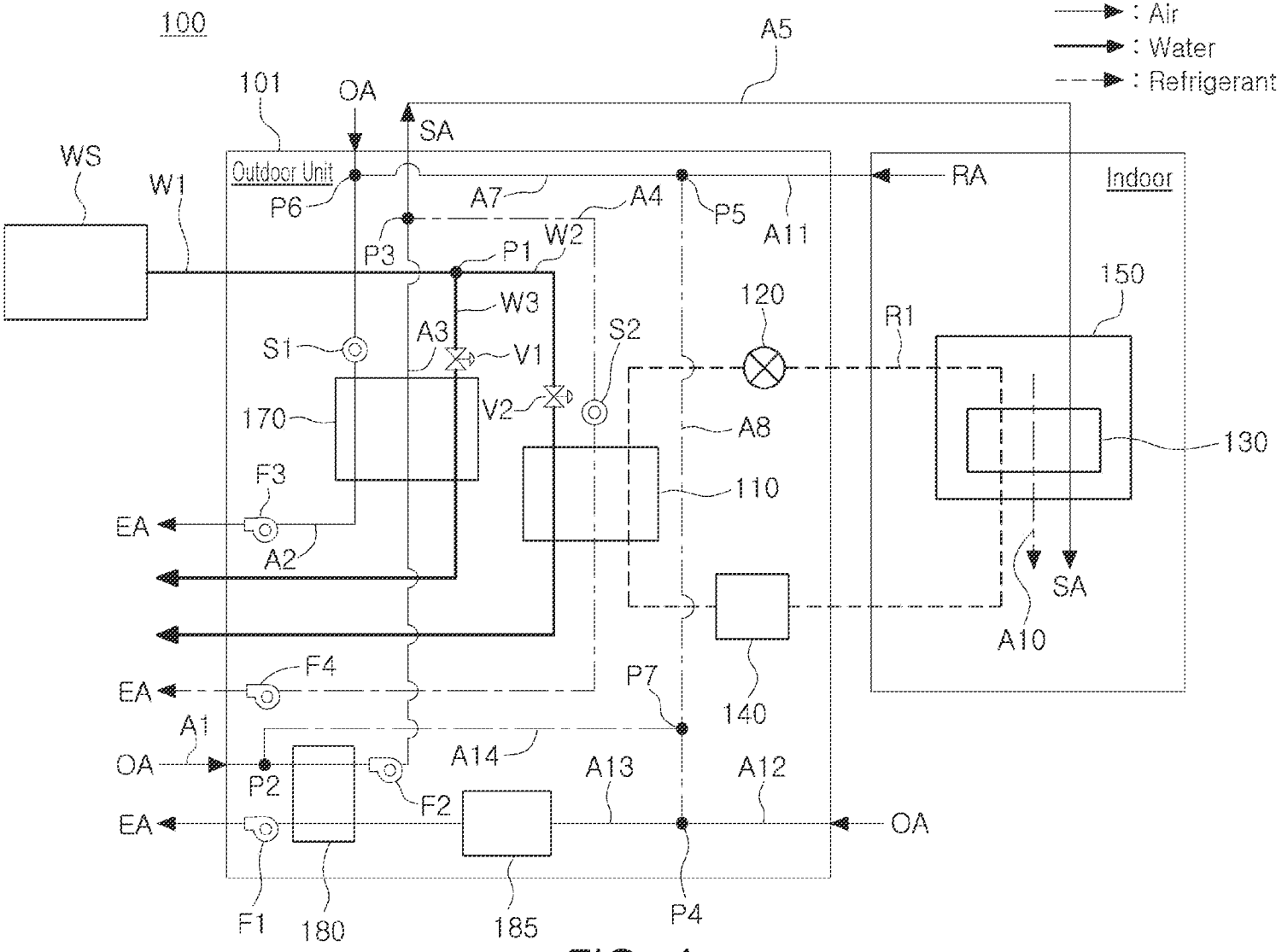
FIG. 4 is a schematic diagram of the air handling unit in FIG. 1 operating in dehumidification ventilation mode.

FIGS. 2 to 4 illustrate the flow path in each operating mode of the air conditioner 100 in FIG. 1. FIG. 2 is a schematic diagram illustrating the flow rate of the air conditioner 100 when operating in cooling mode, FIG. 3 is a schematic diagram illustrating the flow path of the air conditioner 100 when operating in a cooling ventilation mode, and FIG. 4 is a schematic diagram illustrating the flow path of the air conditioner 100 when operating in a dehumidification cooling mode.

As illustrated in FIG. 2, in the cooling mode, the refrigerant cycle operates, and the ventilation flow path A11 is blocked. The air introduced into the outdoor unit 101 through the inlet flow path A1 decreases the humidity through the dehumidifying rotor 180, and then the temperature decreases as it passes through the dry channel of the evaporative cooler 170. Meanwhile, the outside air is supplied to the wet channel of the evaporative cooler 170 through the outside air flow path A2, and the outside air passing through the wet channel is exhausted to the outside again. In addition, in order to regenerate the dehumidifying rotor 180, the outside air is supplied through the regeneration flow paths A12, 13, and the temperature is raised by a heating unit 185 and then the dehumidifying rotor 180 is regenerated and discharged to the outside As illustrated in FIG. 3, the refrigerant cycle operates similarly to the cooling mode in the cooling ventilation mode. However, since ventilation is required in the cooling ventilation mode, indoor air escapes through the ventilation flow path A11, and outside air flows into the indoor supply flow path A5. The air introduced into the outdoor unit 101 through the inlet flow path A1 in the cooling ventilation mode decreases humidity through the dehumidification rotor 180, and then the temperature decreases as it passes through the dry channel of the evaporative cooler 170. Some of the outside air whose temperature/humidity is lowered in this way is supplied to the evaporative condenser 110, and the rest is supplied to the indoor through the indoor supply flow path A5. The air supplied to the evaporative condenser 110 condenses the refrigerant while passing through the evaporative condenser 110.

Meanwhile, the wet channel of the evaporative cooler 170 is supplied with indoor air to the outside air through the outside air flow path A2 through the ventilation flow path A7, and the air passing through the wet channel is exhausted to the outside.

Also, in order to regenerate the dehumidification rotor 180, the outside air is supplied through the regeneration flow paths A12, 13, and after being heated in the heating part 185, the dehumidification rotor 180 is regenerated and discharged to the outside.

As illustrated in FIG. 4, the refrigerant cycle does not operate in the dehumidification cooling mode, and indoor air is discharged through the ventilation flow path A11 and outside air is introduced into the indoor supply flow path A5. In the dehumidification ventilation mode, the air introduced into the outdoor unit 101 through the inlet flow path A1 passes through the dehumidification rotor 180, the humidity is lowered, and then the temperature is lowered as it passes through the evaporative cooler 170, and is supplied to the indoor through the indoor supply flow path A5. In this case, the fan in the indoor unit 150 is operated to flow the indoor air, and the dehumidified/cooled air supply air may be mixed with the flowing indoor air.

Meanwhile, the wet channel of the evaporative cooler 170 is supplied with the indoor air to the outside air through the outside air flow path A2 through the ventilation flow path A7, and the air passing through the wet channel s exhausted to the outside.

In this case, since the refrigerant cycle does not operate, the evaporative condenser 110 also does not operate, and therefore all the air passing through the evaporative cooler 170 is supplied to the indoor through the indoor supply flow path A5. Also, in order to regenerate the dehumidification rotor 180, the outside air is supplied through the regeneration flow paths A12, 13, and after being heated in the heating part 185, the dehumidification rotor 180 is regenerated and discharged to the outside.

The air conditioner 100 according to one embodiment of the present disclosure operates with water and electricity, and utilizes the latent heat of evaporation of water. In the conventional case, there was no major concern about the amount of water, but in order to protect the environment and reduce the user's burden, it is necessary to minimize the amount of water consumed, and for this purpose, the present disclosure includes the first and second temperature and humidity sensors S1, S2, and the first and second temperature and humidity sensors S1, S2 can reduce the amount of water used by reducing the low rate when the conditions threshold values are below a certain temperature and humidity level threshold value.

In particular, when cooling with the air conditioner 100, it may be used as the maximum cooling load, but actually most of the time is used as a cooling load lower than the maximum cooling load. However, since the air conditioner 100 is designed to enable maximum cooling load, it is necessary to adjust the amount of water. For your reference, even in IEER Intercooled Energy Efficiency Patio, which indicates integrated cooling efficiency, the weighting is the highest at 75% cooling load, followed by the weight at 50% cooling load.

That is, energy consumption in partial loads is important, and the present disclosure includes the first and second temperature and humidity sensors S1, S2 connected to the control unit to measure the load, and the control unit controls the amount of water supplied to the evaporative condenser 110 and the evaporative cooler 170 based on the first and second temperature and humidity sensors S1, S2.

Also, in the evaporative cooler 170 and the evaporative condenser 110, the injection of selected water affects the performance, and since the spray nozzle can be affected by the amount of water, the present disclosure controls the amount of water by adjusting the water supply cycle, without directly adjusting the amount of water.

Figure 5:
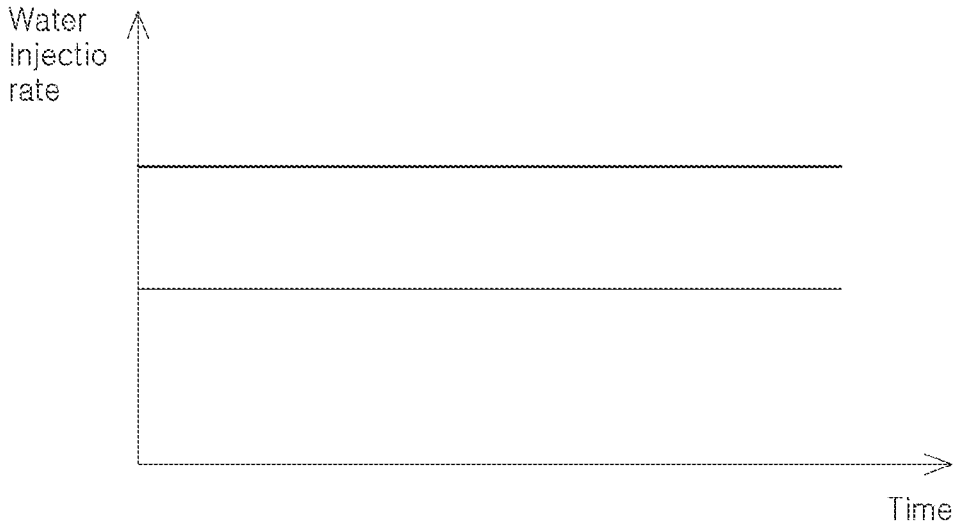
FIG. 5 is a graph illustrating the opening and closing patterns of the first and second control valves, a is a conventional opening/closing pattern, and b is a graph illustrating one example of the opening/closing pattern according to the present disclosure.
Figure 5:
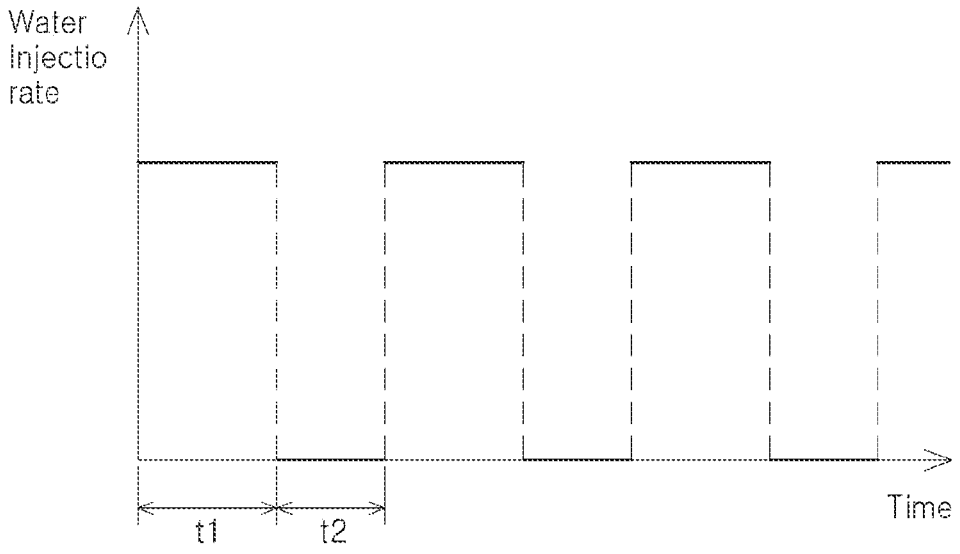

FIG. 5 is a graph illustrating the opening and closing patterns of the first and second control valves V1, V2, a is a conventional opening/closing pattern, and b illustrates an example of an opening and closing pattern according to the present disclosure.

In the embodiment, in case of full load in the cooling mode as in FIG. 2, when the first and second control valves V1, V2 are opened to supply water to the evaporative condenser 110 and the evaporative cooler 170, if the cooling load is reduced, the control unit does not reduce the opening of the first and second control valves V1, V2, but reduce the amount of water supplied to the evaporative condenser 110 and the evaporative cooler 170 in an opening/closing pattern by the method of closing the first and second control valves V1 and V2 for a predetermined period of time. Referring to FIG. 5, when 90% of the water amount is supplied relative to the maximum cooling load, the time t1 when the first and second control valves V1, V2 are opened is 9 seconds, the time t2 when the first and second control valves V1, V2 are closed is 1 second, and thus, 90%=9 seconds is opened during one cycle 9+1 seconds, so the total amount of supplied water can only be supplied by 90%.

By adjusting the opening and closing pattern in this manner, it is possible to adjust the amount of water according to the cooling loads of the evaporative condenser 110 and the evaporative cooler 170 through the first and second control valves V1, V2.

Furthermore, it is also possible to adjust the amount of water according to the cooling load by considering the state temperate/humidity of the air entering the evaporative condenser 110 and the evaporative cooler 170. In other words, evaporation occurs well when the air is high temperature and dry, but evaporation does not occur well when the humidity is high at low temperatures. Therefore, even the injection water module is sprayed or sprayed with the same amount of water, the amount of evaporation actually generated may vary depending on the condition.

In the present disclosure, the control unit can operate by measuring the temperature and humidity of air entering the evaporative condenser 110 and the evaporative cooler 170 through the first and second temperature and humidity sensors S1, S2, predicting the amount of evaporation at that temperature, and supplying an amount of water suitable for the relevant conditions.

The control unit predicts the amount of water required for the evaporative cooler 170 and the evaporative condenser 110 from the measured values of the first and second temperature and humidity sensors S1, S2 cooling load prediction, and the amount of water required from the evaporative cooler 170 is less than the amount provided by the cooler injection water module, and the amount of water required by the evaporative condenser 110 is less Than the amount of water provided by the condenser injection water module, the first and second control valves V1, V2 are adjusted from an open to an opening/closing pattern, or if they are already operating in an opening/closing pattern, the amount of water supplied is controlled by adjusting the opening and closing pattern that opens the control valves V1, V2 at a certain period, that is, adjusting the opening time t1 and the closing time t2.

In this embodiment, since the evaporative condenser 110 and the evaporative cooler 170 are linked, it is advantageous to control by adjusting the opening and closing pattern when both the air conditions supplied to the evaporative condenser 110 and the evaporative cooler 170 are below a certain level.

In addition, the amount of water can be adjusted by identically adjusting the opening and closing pattern not only in the cooling mode, but also in the cooling ventilation mode or dehumidifying cooling mode, thereby reducing the amount of water consumed in each mode cooling, cooling, dehumidifying to improve a user's burden and energy efficiency.

Meanwhile, the controlled amount of water may be less in the cooling ventilation mode than in the cooling mode. Since all air passing through the evaporative cooler 170 is supplied to the evaporative condenser 110 in the cooling mode, the required cooling load may be less than in the cooling ventilation mode, and therefore, it is easy to apply the opening/closing pattern.

Figure 6:
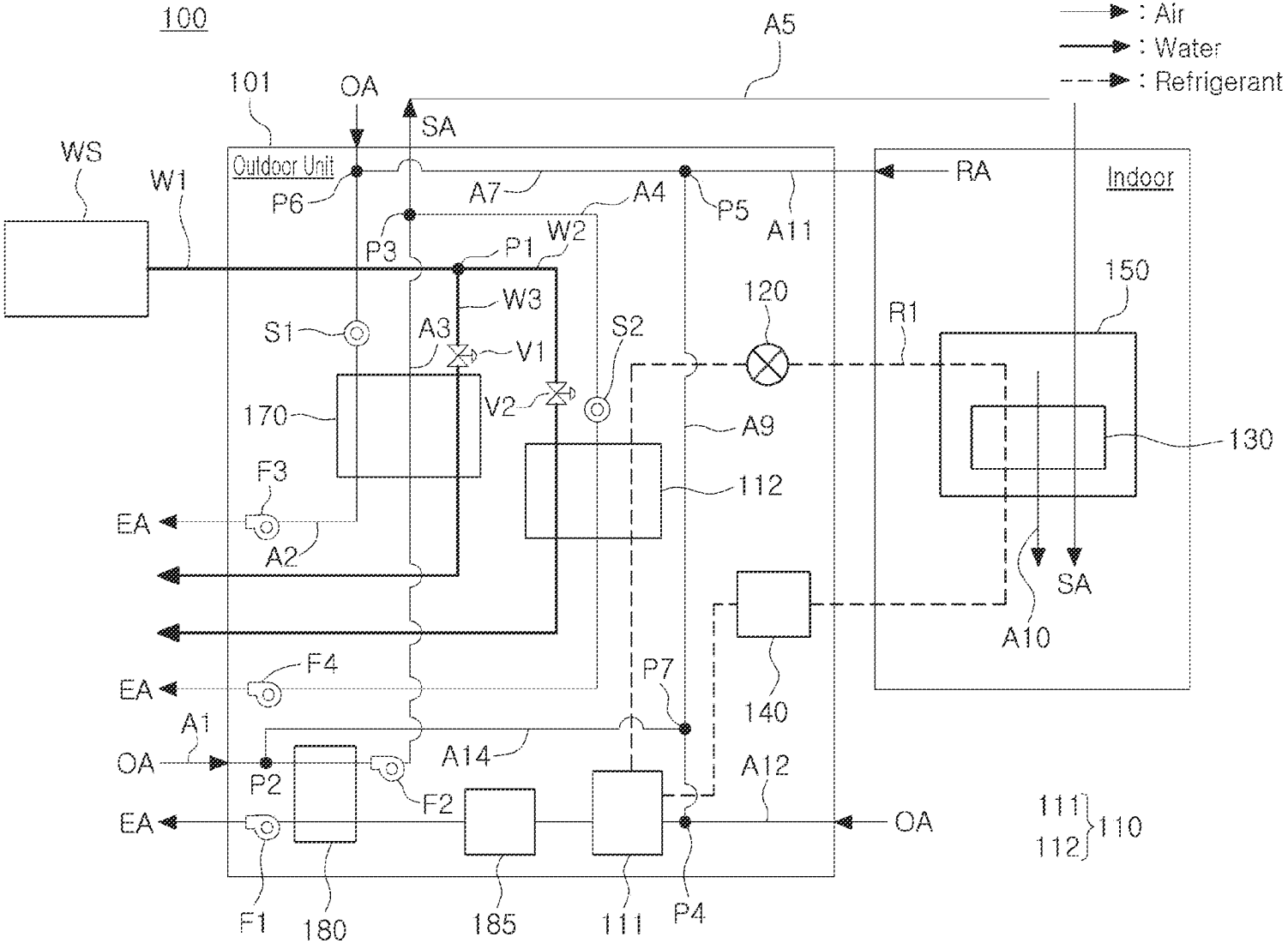
FIG. 6 is a schematic diagram of an air conditioner according to another embodiment of the present disclosure.

Meanwhile, another embodiment of the present disclosure is illustrated in FIG. 6.

In the case of the embodiment in FIG. 6, since the basic configuration of FIG. 1 is the same as that of the embodiment of FIG. 1, the same configuration is replaced with the explanation of FIG. 1, and the differences between the embodiments in FIG. 6 and FIG. 1 will be mainly explained.

In the embodiment of FIG. 6, in the refrigerant cycle R1, the condenser 110 includes a first condenser 111 and a second condenser 112, the second condenser 112 is an evaporative condenser, and the first condenser 111 is a gas-liquid heat exchanger.

The refrigerant cooled by the evaporator 130 is compressed by the compressor 140 and then supplied to the first condenser 111. The first condenser 111 is disposed on the regeneration flow paths A12, A13, and preferably between the confluence point P4 where the ventilation flow path A9 and the regeneration flow path A13 loin and the heating unit 185. Since the refrigerant discharged from the compressor 140 in the refrigerant cycle R1 is high temperature and high pressure, the temperature of the refrigerant in the first condenser is sufficiently high, for example, 70° C. or higher, and outdoor or indoor air flowing for regeneration can be heated. When the air from the regeneration flow paths A12, A13 is heated once, the use of hot water or electrical energy used in the heating unit 185 may be reduced, and the condensation is performed primarily while passing through the first condenser 111, the condensation load required to be cooled in the second condenser 112, that is, the cooling load, may be reduced.

Therefore, since the amount of water to be supplied to the second condenser 112, which is an evaporative condenser, decreases, and the amount of hot water or electrical energy to be used by the heating unit 185 decreases the overall energy consumed by the air conditioner 100 to efficiently achieve air conditioning.

Figure 7:
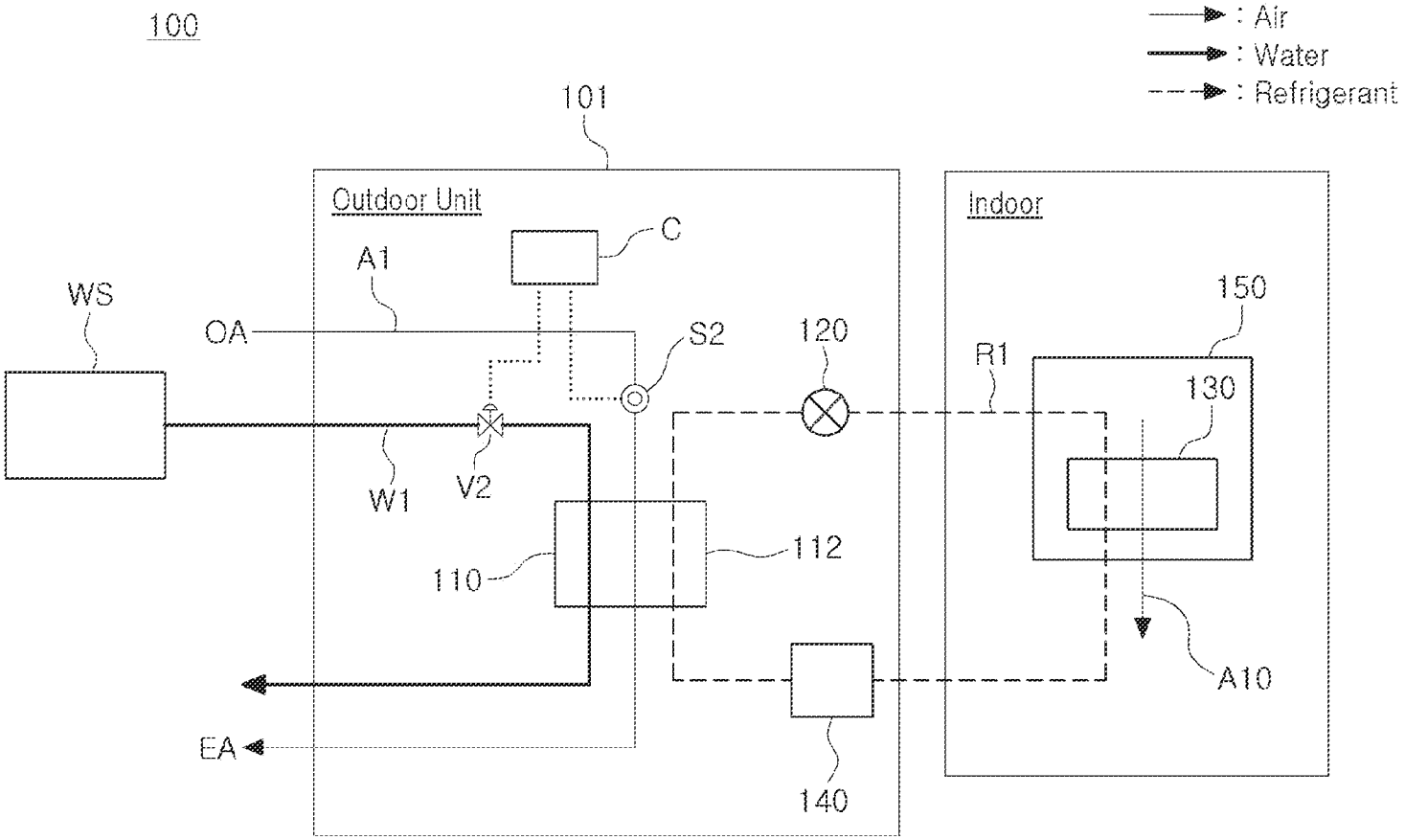
FIG. 7 is a schematic diagram of an air conditioner according to another embodiment of the present disclosure.

Another embodiment of the present disclosure is illustrated in FIG. 7.

In the case of the embodiment in FIG. 7, the embodiment in FIG. 1 includes only a configuration centered on a refrigerant cycle R1, and does not include the evaporative cooler 170 or the dehumidification rotor 180, so it is simply configured.

The refrigerant cooled by the evaporator 130 is compressed by the compressor 140 and then supplied to the condenser 110. In this case, the condenser 110 is the evaporative condenser. The refrigerant passing through the condenser 110 passes through the expansion valve 120 and is supplied to the evaporator 130 again, and circulates through the refrigerant cycle R1.

In this embodiment, the inlet flow path A1 and the water supply flow path W1 are connected to the condenser 110, which is an evaporative condenser, a second control valve V2 is disposed in the water supply flow path W1, and the second temperature and humidity sensor S2 is disposed in the inlet flow path A1. The second control valve V2 and the second temperature and humidity sensor S2 are connected to the control unit C, and the control unit C adjusts the second control valve V2 based on the measured value of the second temperature and humidity sensor S2. The control unit C is illustrated to be equipped with an outdoor unit, but it does not necessarily have to be equipped with the outdoor unit, and may be disposed in the indoor unit or other locations as necessary.

The control unit C measures the temperature and/or humidity of the air flowing into the condenser 110 through the second temperature and humidity sensor S2, and can accordingly adjust the required amount of water through the second control valve V2. In this case, the second control valve V2 can be adjusted only by opening or closing without adjusting the opening, and it is possible to supply a necessary amount of water by adjusting the opening time and closing time.

The control unit C can change the opening/closing pattern in a predetermined pattern based on whether the measured value of the second temperature and humidity sensor S2 exceeds a predetermined value, and may have a plurality of patterns.

The scope of the present disclosure is not limited to the embodiments illustrated above, and a person skilled in the art can modify various matters based on the present disclosure within the aforementioned technical scope.

While example embodiments have been shown and described above, it will be apparent to those skilled in the art that modifications and variations could be made without departing from the scope of the present invention as defined by the appended claims.

DESCRIPTION OF THE LABELS

100: Air conditioner
101: Outdoor unit
110: Condenser
111: First condenser
112: Second condenser
120: Expansion valve
130: Evaporator
140: Compressors
150: Indoor unit
170: Evaporative cooler
180: Dehumidification rotor
185: Heating part
WS: Water source F1~F4: Fan

What is claimed is:

1. An air conditioner including an evaporator, an expansion valve, a compressor, and an evaporative condenser through which refrigerant circulates, the air conditioner comprising:

an outdoor unit in which the evaporative condenser is disposed;

an indoor unit in which the evaporator is disposed; and a controller connected to the indoor unit and the outdoor unit;

wherein the evaporative condenser includes a cooling flow path through which the refrigerant passes and a condenser water injector, water supplied to the condenser water injector being sprayed onto the cooling flow path to cool the refrigerant, wherein the outdoor unit includes a first control valve for controlling water supplied to the condenser water injector, wherein the controller is connected to the first control valve and changes an amount of water supplied through the first control valve according to operating conditions, wherein the controller controls opening and closing of the first control valve according to an opening and closing pattern in which the first control valve is opened for a certain period of time and closed for a certain period of time to change the amount of water supplied through the first control valve, the opening and closing pattern is such that, when the amount of water supplied is N % of the maximum cooling load, an opening time t1 of the first control valve is set to N*0.1 seconds, and a closing time t2 of the first control valve is set to 10-t1 seconds, thereby periodically changing the opening time t1 and the closing time t2 of the first control valve, wherein the outdoor unit includes a first temperature and humidity sensor that measures temperature and humidity of the evaporative condenser, the first temperature and humidity sensor being connected to the controller, and wherein the controller further adjusts the opening and closing pattern based on the measured value of the first temperature and humidity sensor, wherein the controller controls the first control valve only to open or close, and the first control valve is fully open when opened.

2. The air conditioner of claim 1, wherein the outdoor unit includes an evaporative cooler having a dry channel, a wet channel disposed to exchange heat with the dry channel, and a cooler water injector, a first inlet flow path through which outside air flows into the dry channel, a second inlet flow path through which outside air flows into the dry channel, and a second control valve that controls the water supplied to the cooler water injector, water supplied to the cooler water injector being sprayed onto the wet channel, wherein the controller is connected to the first and second control valves and controls opening and closing of at least one of the first and second control valves to change the amount of water supplied through the at least one of the first and second control valves according to operating conditions.

3. The air conditioner of claim 2, wherein the controller controls opening and closing of the at least one of the first and second control valves according to an opening and closing pattern in which the at least one of the first and second control valves is opened for a predetermined time and then closed for a predetermined time to change the amount of water supplied through the at least one of the first and second control valves, the opening and closing pattern is such that, when the amount of water supplied is N % of the maximum cooling load, the opening time t1 of the first and second control valves is set to N*0.1 seconds, and the closing time t2 of the first and second control valves is set to 10-t1 seconds, thereby periodically changing the opening time t1 and the closing time t2 of the first and second control valves.

4. The air conditioner of claim 3, wherein the outdoor unit further comprises a dehumidifying rotor disposed before the evaporative cooler on the second inlet flow path, and dehumidifying incoming air; and a heater placed before the dehumidifying rotor on a regeneration flow path through which the air for regenerating the dehumidifying rotor passes to heat the air;

wherein the dehumidification rotor is disposed over the regeneration flow path and the second inlet flow path, and the second inlet flow path passes through the evaporative cooler and then branches into an indoor supply flow path connected to the indoor unit and a condenser supply flow path connected to the evaporative condenser.

5. The air conditioner of claim 3, wherein the controller controls opening and closing of the at least one of the first and second control valves only by opening or closing the at least one of the first and second control valves.

6. The air conditioner of claim 4, wherein the outdoor unit includes a first temperature and humidity sensor that measures temperature and humidity of the first inlet flow path of the evaporative cooler and a second temperature and humidity sensor that measures temperature and humidity of an outlet of the dry channel of the evaporative cooler, the first and second temperature and humidity sensors are connected to the controller, and wherein the controller further adjusts the opening and closing pattern based on the measured value of at least one of the first and second temperature and humidity sensors.

7. The air conditioner of claim 4, wherein the controller operates in a plurality of operation modes, wherein the operation modes include a cooling mode and a cooling ventilation mode, wherein in the cooling mode, the controller controls outside air to pass through the evaporative condenser, the evaporative cooler, and the dehumidification rotor, and wherein in the cooling ventilation mode, the controller controls supply of indoor air to the wet channel of the evaporative cooler and part of the air passing through the dry channel of the evaporative cooler to the indoor unit.

8. The air conditioner of claim 6, wherein the controller changes the opening and closing pattern to a predetermined pattern based on whether the measured value of at least one of the first temperature and humidity sensor and the second temperature and humidity sensor exceeds a threshold value.

9. The air conditioner of claim 8, wherein the controller controls opening and closing of the first and second control valves based on, respectively, the amount of water required by the evaporative cooler for the measured value of the first temperature and humidity sensor relative to the amount provided by the cooler water injector, and the amount of water required by the evaporative condenser for the measured value of the second temperature and humidity sensor relative to the amount of water provided by the condenser water injector.

10. An air conditioner including an evaporator, an expansion valve, a compressor, and an evaporative condenser through which refrigerant circulates, the air conditioner comprising:

an outdoor unit in which the evaporative condenser is disposed;

an indoor unit in which the evaporator is disposed; and a controller connected to the indoor unit and the outdoor unit, wherein the evaporative condenser includes a cooling flow path through which the refrigerant passes and a condenser water injector, water supplied to the condenser water injector being sprayed onto the cooling flow path to cool the refrigerant, wherein the outdoor unit includes a first control valve for controlling water supplied to the condenser water injector;

an evaporative cooler including a dry channel, a wet channel arranged to heat exchange with the dry channel, a cooler water injector, and an inlet flow path through which outside air flows into the dry channel is connected, water supplied to the cooler water injector being sprayed onto the wet channel; and a first temperature and humidity sensor that measures the temperature and humidity at an inlet of the evaporative cooler or a second temperature and humidity sensor that measures an outlet side of the dry channel of the evaporative cooler, wherein the controller is connected to the first control valve, and controls opening and closing of the first control valve to change an amount of water supplied through the first control valve according to operating conditions, wherein the outdoor unit further includes a second control valve for adjusting the water supplied to the cooler water injector, and wherein the controller controls opening and closing of the second control valve according to an opening and closing pattern based on the measured value of the first temperature and humidity sensor or the second temperature and humidity sensor, wherein the controller controls opening and closing of the second control valve according to the opening and closing pattern opening in which the second control valve is opened for a certain period of time and closed for a certain period of time to change the amount of water supplied through the second control valve, the opening and closing pattern is such that, when the amount of water supplied is N % of the maximum cooling load, an opening time t1 of the second control valve is set to N*0.1 seconds, and a closing time t2 of the second control valve is set to 10-t1 seconds, thereby periodically changing the opening time t1 and the closing time t2 of the second control valve, wherein the controller controls the first and second control valves only to open or close, and the first and second control valves are fully open when opened.

11. An outdoor unit of an air conditioner, comprising:

an evaporative condenser including a cooling flow path through which a refrigerant passes to condense the passing refrigerant and a condenser water injector, water supplied to the condenser water injector being sprayed onto the cooling flow path to cool the refrigerant;

a first control valve that adjusts water supplied to the condenser water injector;

a second temperature and humidity sensor disposed on an inlet side of the evaporative condenser to measure the temperature and humidity of the air supplied to the evaporative condenser; and a controller connected to the second temperature and humidity sensor and the first control valve, wherein the controller controls opening and closing of the first control valve according to an opening and closing pattern based on the measured value of the second temperature and humidity sensor, wherein the controller controls the opening and closing of the first control valve according to the opening and closing pattern only by opening or closing the first control valve, wherein the controller controls opening and closing of the first control valve according to the opening and closing pattern in which the first control valve is opened for a certain period of time and closed for a certain period of time to change the amount of water supplied through the first control valve, the opening and closing pattern is such that, when the amount of water supplied is N % of the maximum cooling load, an opening time t1 of the first control valve is set to N*0.1 seconds, and a closing time t2 of the first control valve is set to 10-t1 seconds, thereby periodically changing the opening time t1 and the closing time t2 of the first control valve, wherein the controller controls the first control valve to open or close, and the first control valve is fully open when opened.

12. The outdoor unit of the air conditioner of claim 11, wherein the controller changes the opening and closing pattern to a predetermined pattern based on whether the measured value of the second temperature and humidity sensor exceeds a predetermined value.

* * * * *